United States Patent [19]

Reynolds

[11] 4,019,046

[45] Apr. 19, 1977

[54] HEADLIGHT SAFETY COVER

[76] Inventor: Lawrence Edwin Reynolds, Colony St., Meriden, Conn. 06450

[22] Filed: July 16, 1975

[21] Appl. No.: 567,408

[52] U.S. Cl. ..... 240/46.59; 240/41.38 A

[51] Int. Cl.[2] ..... F21J 9/08

[58] Field of Search ..... 240/46.59, 46.57, 41 R, 240/41.38 R, 41.38 A

[56] References Cited

UNITED STATES PATENTS

| | | | |
|---|---|---|---|
| 1,461,924 | 7/1923 | Luyties | 240/46.59 |
| 1,856,073 | 5/1932 | Graham | 240/46.59 X |
| 1,973,361 | 9/1934 | Smalley | 240/46.59 |
| 2,107,801 | 2/1938 | Query | 240/46.59 |
| 2,199,014 | 4/1940 | Stilt | 240/46.59 X |
| 2,304,861 | 12/1942 | Thee | 240/46.59 X |
| 2,539,819 | 1/1951 | Domenick | 240/46.59 |
| 2,544,378 | 3/1951 | Cyr | 240/46.59 |
| 3,382,354 | 5/1968 | Hedgeurck et al. | 240/41.38 R |

*Primary Examiner*—Edna M. O'Connor

[57] ABSTRACT

The Day Life Saver is a headlight safety cover that utilizes the natural vibrations of a motorcycle when operated with the headlight turned on to change the illuminating light from the headlight to a vibrating orange colored light.

2 Claims, 6 Drawing Figures

FIG. 1
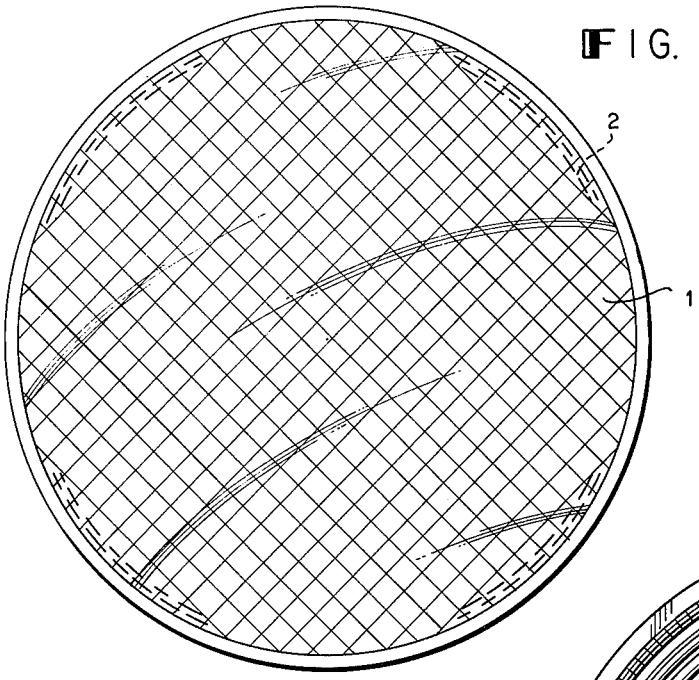
FIG. 5
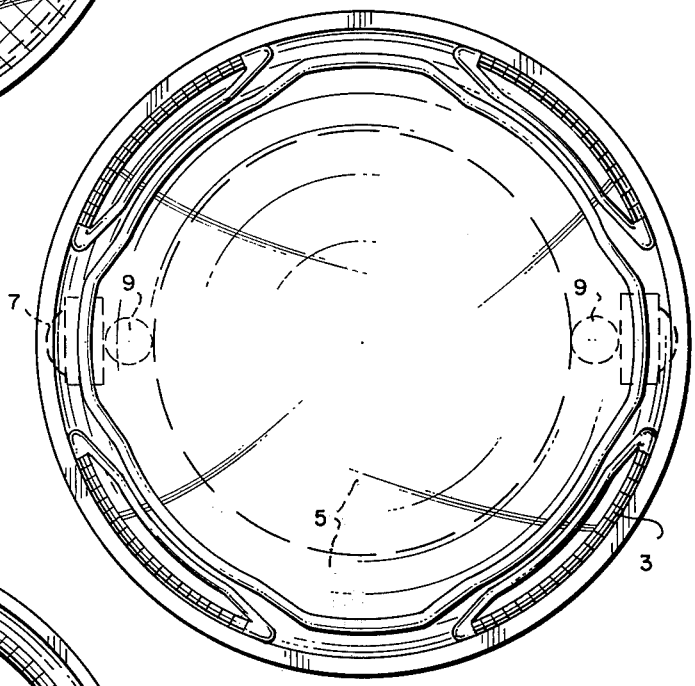
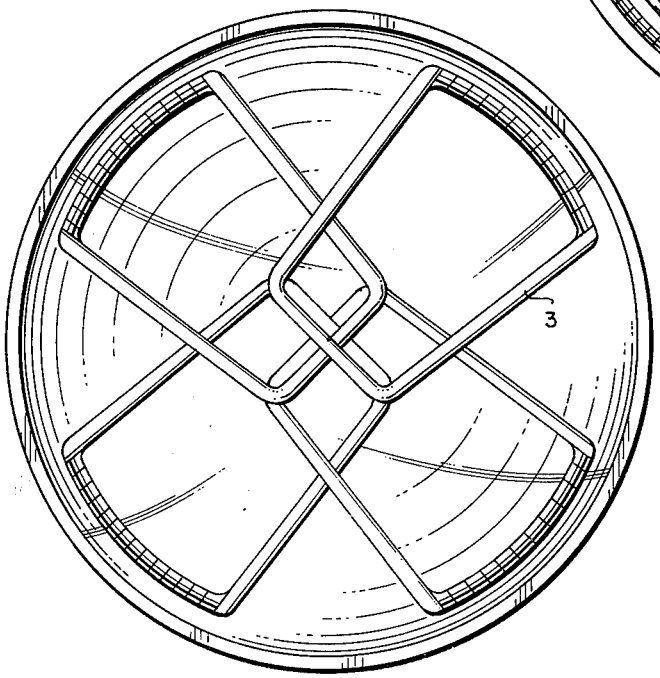
FIG. 2

HEADLIGHT SAFETY COVER

BRIEF SUMMARY OF THE INVENTION

My invention comprises a cover which is to be fitted over the headlight of a motorcycle to improve the visibility of the motorcycle during the daylight hours. The cover has a large, preferably orange colored lens that will vibrate during locomotion of the motorcycle. The orange colored lens will overlie the headlight lens, and a fabric attachment sleeve is connected to the periphery of the lens and has clamp-like springs for holding the lens over headlights of various sizes.

BRIEF DESCRIPTION OF THE DRAWINGS

FIG. 1 is a front view of my headlight safety cover.

FIG. 2 is a rear view of my safety cover showing the spring clamps.

FIG. 5 is another rear view of my safety cover showing the relative positioning of the safety cover and components of the headlight illustrated in phantom.

DESCRIPTION OF THE PREFERRED EMBODIMENT

Figure 3:
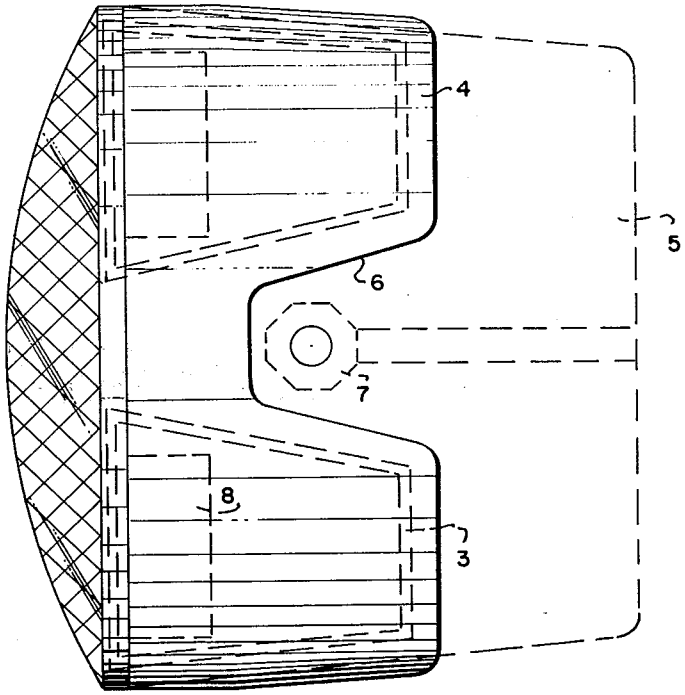
FIG. 3 is a side elevation view of my safety cover shown mounted on a headlight illustrated in phantom.
Figure 4:
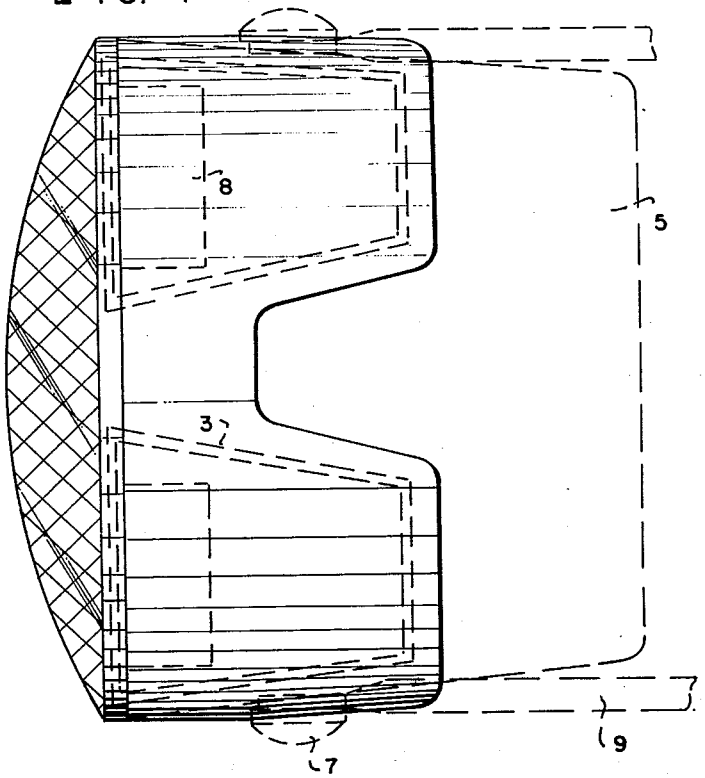
FIG. 4 is a top plan view of the safety cover and headlight shown in FIG. 3.
Figure 6:
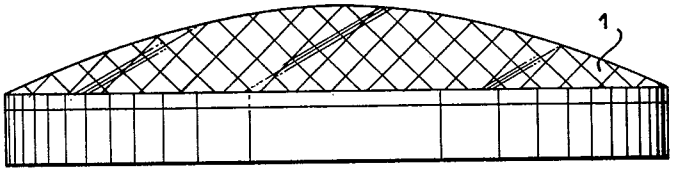
FIG. 6 is a side elevation view of my safety cover in a storage condition.

FIG. 1 shows the front view of my (day life saver) headlight safety cover 1 with a schematic view of the location of plastic or rubber foam bumpers 2 which will allow the orange colored lens to vibrate upon the locomotion of any motorcycle, thereupon making the motorcycle more visible. FIG. 2 shows a rear view of the (day life saver) safety cover before spring clamps 3 are covered with a fabric attachment sleeve. FIG. 3 shows a side view of the (day life saver) cover and the motorcycle headlight 5. The orange colored fabric sleeve 4 houses the four clamp springs 3. Headlight sleeve 4 is shaped at the region 6 so that it may be placed over any motorcycle headlight 5 in four different ways so as to encompass the headlight mounting nuts and bolts 7. FIGS. 3 and 4 show the locations 8 of the rubber or plastic foam bumpers mounted on the inside of the double layered sleeve 4. FIG. 4 only shows the top view of the headlight 5 just to be able to depict the fact that the (day life saver) cover can be placed over the headlight in four different ways. FIG. 5 is another rear view showing the spring clamps 3 open and clamped around headlight 5. FIGS. 4 and 5 show the headlight mounting bars 9 at each side of the headlight 5. FIG. 6 is side view showing the (day life saver) cover 1 collapsed and ready for storage.

I claim:

1. A headlight safety cover to be fitted over the headlight of a motorcycle or the like to improve visibility of the motorcycle when the headlight is illuminated during daylight hours comprising: a colored lens having a size and shape adapted to overlie substantially the entire headlight lens; an attachment sleeve connected to the periphery of the colored lens and having clamp-like springs for holding the colored lens on the headlight; and resilient bumpers within the attachment sleeve positioned for engagement with the exterior of the headlight and having a resiliency permitted vibrating movement of the colored lens relative to the headlight upon movement of the motorcycle or the like.

2. A headlight cover as defined in claim 1 wherein the colored lens is an orange colored lens.

* * * * *